US006438757B1

(12) United States Patent
Quinn

(10) Patent No.: US 6,438,757 B1
(45) **Date of Patent: *Aug. 27, 2002**

(54) WATERPROOF RELIEF OUTLET IN BREATHABLE WADER

(75) Inventor: Michael P. Quinn, Traverse City, MI (US)

(73) Assignee: Fowl Play Clothing and Accessories, L.L.C., Traverse City, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/840,223

(22) Filed: Apr. 23, 2001

Related U.S. Application Data

(63) Continuation-in-part of application No. 09/793,292, filed on Feb. 26, 2001.

(51) Int. Cl.[7] ..... A41D 13/00

(52) U.S. Cl. ..... 2/82; 2/69

(58) Field of Search ..... 2/2.15–2.17, 69, 2/79, 81, 82, 227, 242, 234; 36/4, 2 R, 1.5, 213, 109; 24/381, 382, 384–390, 432; 441/120, 105

(56) References Cited

U.S. PATENT DOCUMENTS

| | | | | | |
|---|---|---|---|---|---|
| 2,385,816 | A | * | 10/1945 | Krupp | 2/82 |
| 2,746,113 | A | * | 5/1956 | Williams | 24/389 |
| 2,853,758 | A | * | 9/1958 | Topf | 2/82 |
| 4,067,064 | A | * | 1/1978 | Cerniway et al. | 2/2.15 |
| 4,274,159 | A | * | 6/1981 | Schmidt | 2/2.15 |
| 5,159,719 | A | * | 11/1992 | Aumann | 2/87 |
| 5,444,898 | A | * | 8/1995 | Norvell | 24/389 |
| 6,223,349 | B1 | * | 5/2001 | Roiser | 2/2.17 |
| 6,317,893 | B1 | * | 11/2001 | Walton | 2/227 |

* cited by examiner

*Primary Examiner*—Gloria M. Hale
(74) *Attorney, Agent, or Firm*—Artz & Artz, P.C.

(57) ABSTRACT

A waterproof relief outlet in a breathable chest wader consisting of a zipper having a zipper portion capable of movement from a closed position to an open position, wherein the zipper prevents water from entering the interior of the chest wader when the zipper portion is in said closed position. The wearer of the breathable chest wader thereby has means for relieving himself without having to substantially remove the waders and/or any undergarments. Further, this is accomplished in a highly simplified manner, wherein the wearer need only to grab a tab coupled to a slide fastener of the zipper portion in order to move the zipper portion from the closed position to the open position.

20 Claims, 4 Drawing Sheets

WATERPROOF RELIEF OUTLET IN BREATHABLE WADER

CROSS REFERENCES TO RELATED APPLICATIONS

This application is a continuation in part of my application Ser. No. 09/793,292, filed on Feb. 26, 2001.

TECHNICAL FIELD

The present invention relates generally to waders and more particularly to a breathable wader having a waterproof relief outlet formed therein.

BACKGROUND

Waders are sportswear that are used by individuals to protect against water penetration while fishing, duck hunting, or otherwise working in a stream or lake. Waders are traditionally rubbers boots that are stepped into and pulled up to the chest of the person. Typically, waders are held up by suspenders or some other type of device to maintain the top of the wader above the level of the water.

Recently, in an effort to improve comfort, waders have been introduced that are lighter, more durable, and completely waterproof yet allows moisture buildup within the wader due to perspiration to pass through to the outside. These "breathable" waders typically incorporate a denier nylon outer shell that is weaved with microporous holes that are small enough prevent larger water molecules from entering the interior of the wader, yet large enough to allow vapor molecules (perspiration) to exit to the exterior of the wader. Thus, a wearer of the wader remains dry and comfortable regardless of weather conditions. To aid in insulating the wader, a layer of insulating material such as Gore-Tex® or Thinsulate™ liner may be added to the interior of the wader.

One problem with currently available waders is that they typically do not provide an easily accessible relief outlet. Therefore, a person wearing waders must remove the waders, or at least lower the waders below their waist, in order to relieve himself.

One proposed solution to the relief outlet problem was presented in U.S. Pat. No. 4,274,159 to Schmidt, in which a waterproof relief outlet having a folded funnel within the chest wader is disclosed. In this patent, a wearer of the chest wader can relieve himself by unlocking the interlocking tongue and then extending a funnel or sleeve through the interlocking tongue. The funnel itself is sealed to the inner surface of the chest wader. When stored, the funnel must be folded in order to ensure it fitting within its allotted space. However, this invention is complicated to use, requiring many steps for an individual to do before being able to relieve his pressure. This problem is exacerbated when a wearer's hands are gloved or not easily manipulated do to cold temperatures. Further, the interlocking tongue is not waterproof; it requires a cover to ensure that water does not leak into the interior of the wader when the funnel housing is held in a closed position.

Accordingly, there is a long felt need to provide an improved breathable wader having a simplified waterproof relief outlet that prevents ingress of water into the breathable waders not heretofore attainable.

It is therefore an object of the present invention to provide a breathable wader having an easily accessible waterproof relief outlet.

SUMMARY OF THE INVENTION

In accordance with the above and the other objects of the present invention, a simplified waterproof relief outlet in a breathable chest wader is provided. The breathable wader has a zipper secured to a center seam therein. The zipper, in its closed position, is completely waterproof and is enclosed at both ends without any additional steps. A wearer of the chest wader can relieve pressure by simply unzipping the breathable wader.

Other objects and advantages of the present invention will become apparent upon considering the following detailed description and appended claims, and upon reference to the accompanying drawings.

DETAILED DESCRIPTION OF THE PREFERRED EMBODIMENT(S)

Figure 1:
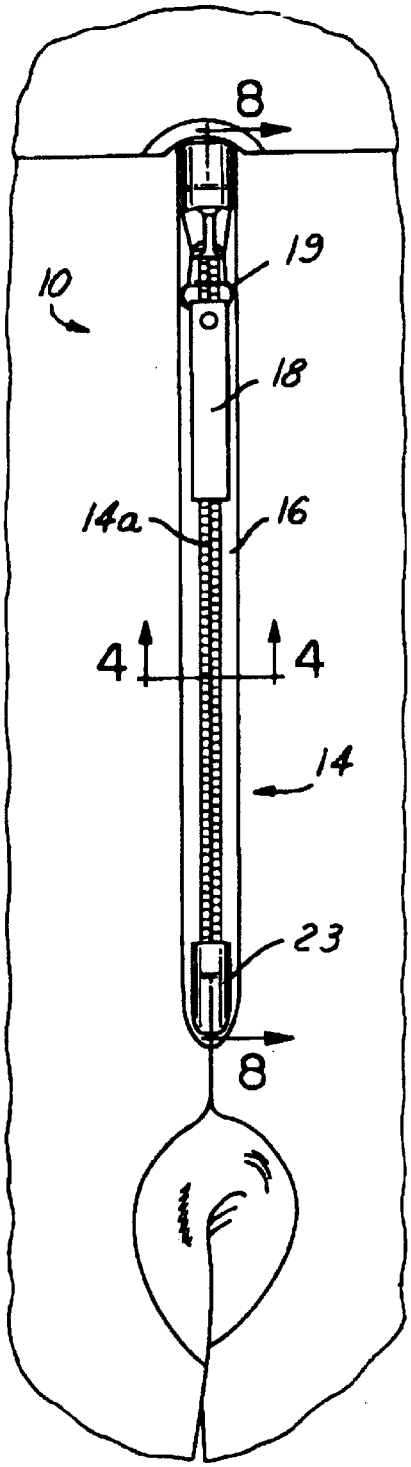
FIG. 1 is a front view of the breathable wader according to a preferred embodiment of the present invention.
Figure 7:
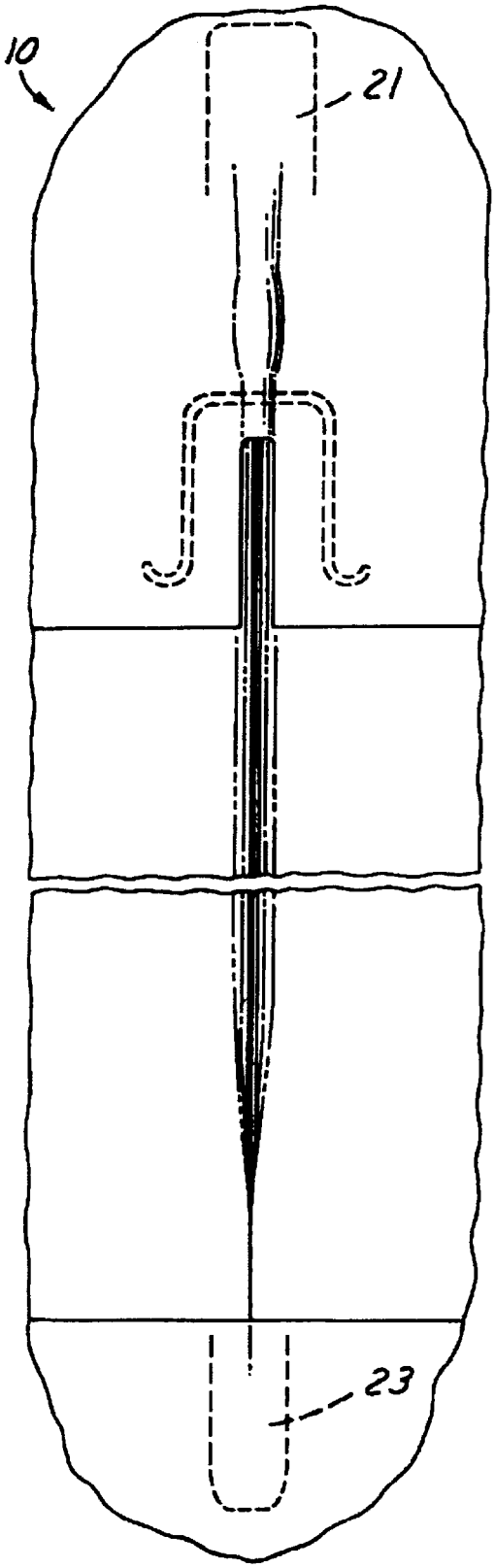
FIG. 7 is an interior view of the zipper of FIG. 2.

Referring now to FIGS. 1 and 7, a water resistant breathable chest wader 10 in accordance with the present invention is depicted. The chest wader 10 may have a belt (not shown) for cinching around a wearer to assist in fitting the wader and holding it up thereby preventing leakage. The wader material is a cloth-like material that is preferable comprised of an breathable outer denier nylon shell and an inner insulating liner material shell such as Gore-Tex® or Thinsulate™. The breathable outer denier nylon shell is a breathable material that is weaved with tiny, microporous holes that are small enough to prevent water molecules from entering the interior of the wader but large enough to allow vapor material, typically perspiration, to exit from the interior of the wader to the outer environment. Of course, breathable materials other than a denier nylon shell and insulating materials other than Gore-Tex® or Thinsulate™ may be used and still fall within the spirit of the present invention.

A pair of suspenders (not shown) may be used in addition to or in place of the belt. The wader 10 also has a waterproof zipper 14 formed therein. The waterproof zipper 14 is located in the vicinity of the wader crotch and consists of a zipper portion 14*a* and a cloth-like portion 16. A wearer of the chest wader 10 can relieve pressure by simply pulling a tab 18 of the slide fastener 19 of the zipper portion 14*a* downward to unlock the zipper portion 14*a* from a closed position, as shown in FIGS. 2 and 8, to an open position, as shown in FIG. 3.

Figure 2:
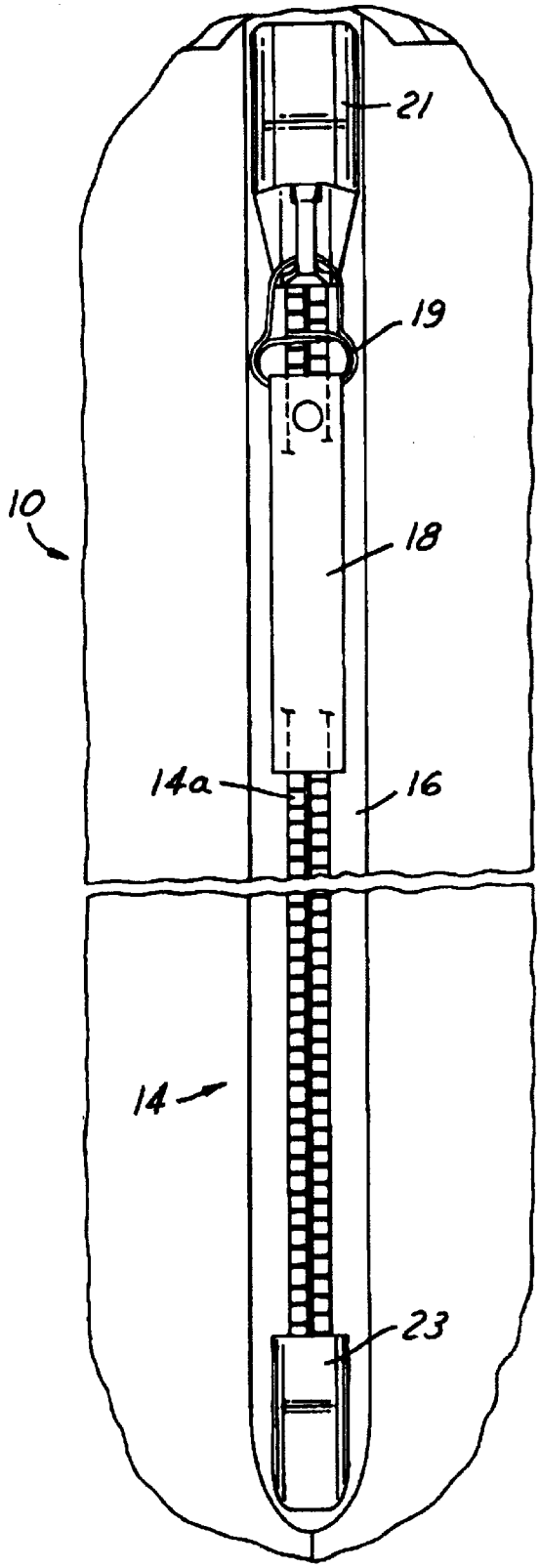
FIG. 2 is an enlarged view of the zipper of FIG. 1 in a closed position.
Figure 8:
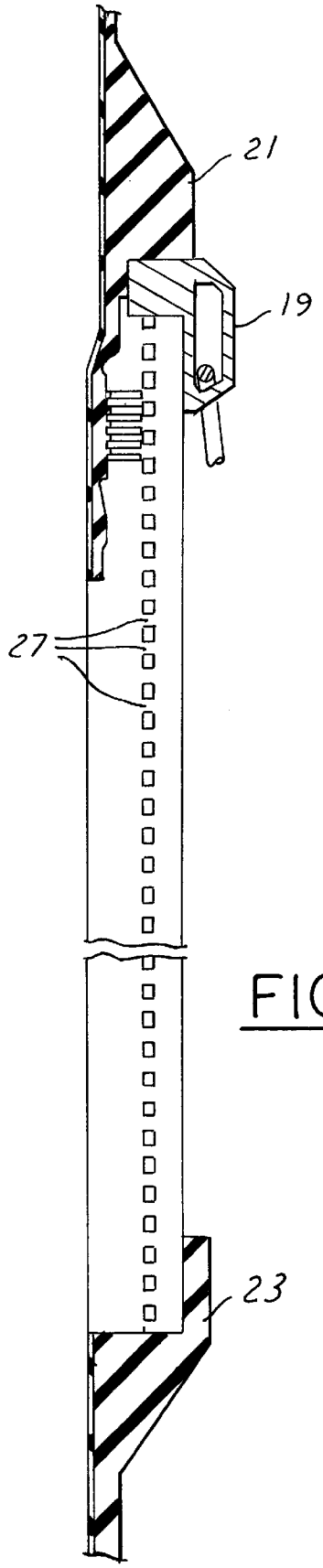
FIG. 8 is a side view of the zipper of FIG. 1 taken along line 8—8.

As best seen in FIGS. 2 and 8, a raised flange 21 abuts against the slide fastener 19 to ensure that the zipper 14 is substantially sealed to prevent water leakage into the interior of the wader 10 when the zipper 14 is in the closed position. In addition, a rubber seal 27 is heat sealed to the inner portion 22 of the wader 10 to provide sealing within the zipper portion 14*a*. The zipper is also depicted as having a lower raised flange 23.

Figure 3:
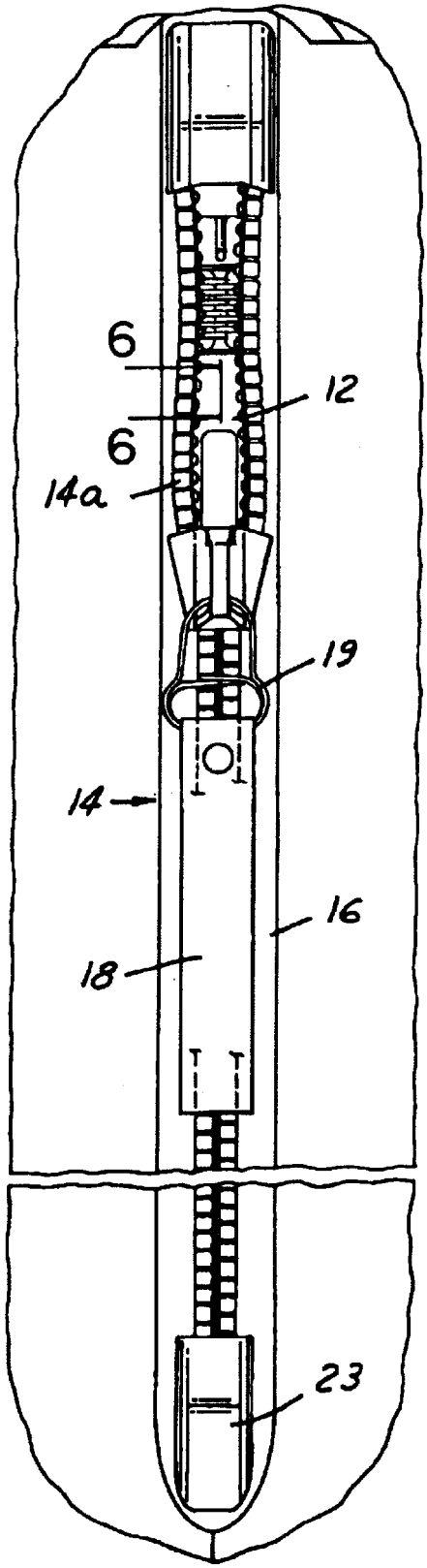
FIG. 3 is an enlarged view of the zipper of FIG. 1 in an open position.

As best seen in FIG. 3, a vertical slit 12 is exposed when the zipper portion 14*a* is opened. The lower raised flange 23 prevents is located on the bottom portion of the zipper 14 and limits the movement of the slide fastener 19 downward. After the user has relieved himself, the slide fastener 19 is simply pulled upward to return the zipper portion 14*a* to the closed position. The tab 18 is typically made of leather or some type of grippable, mostly water resistant material and may be coupled to the slide fastener 19 in a wide variety of method which are known in the art.

Figure 4:
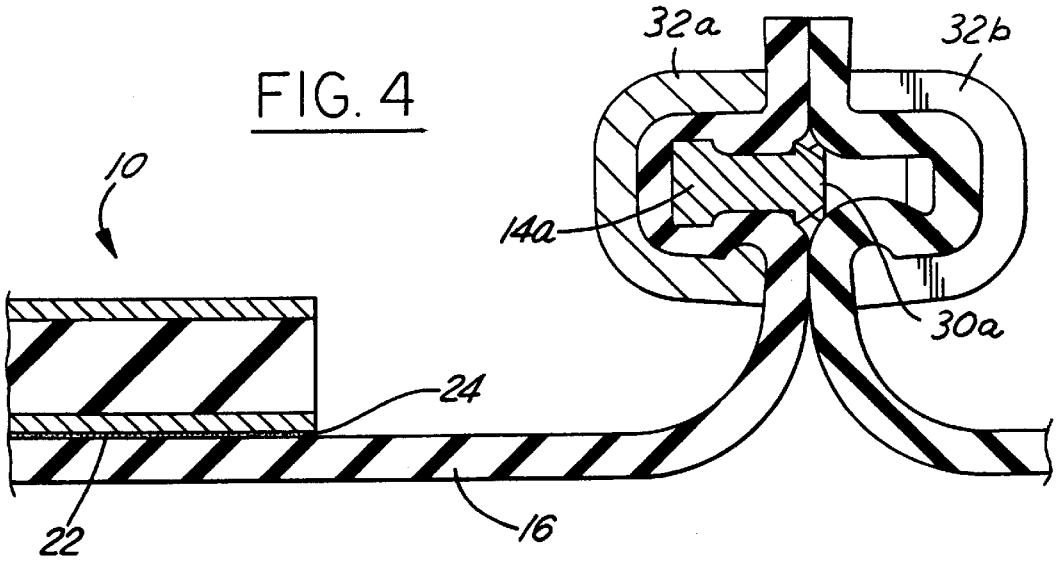
FIG. 4 is a illustration of the zipper of FIG. 1 taken along line 4—4.

As seen in FIG. 4, the cloth material 16 is sealed around the vertical slit 12 to the inner portion 22 of the wader 10 such that the zipper portion 14*a* extends through the vertical slit 12. This allows the zipper portion 14*a* to be accessed from the exterior of the wader. Preferably, the cloth material 16 is a water resistant material and is secured to the inner portion 22 of the shell of the wader 10 using a waterproof sealing material 24 such as neoprene cement to prevent water from penetrating the interior of the wader through the sealing material 24.

Figure 5:
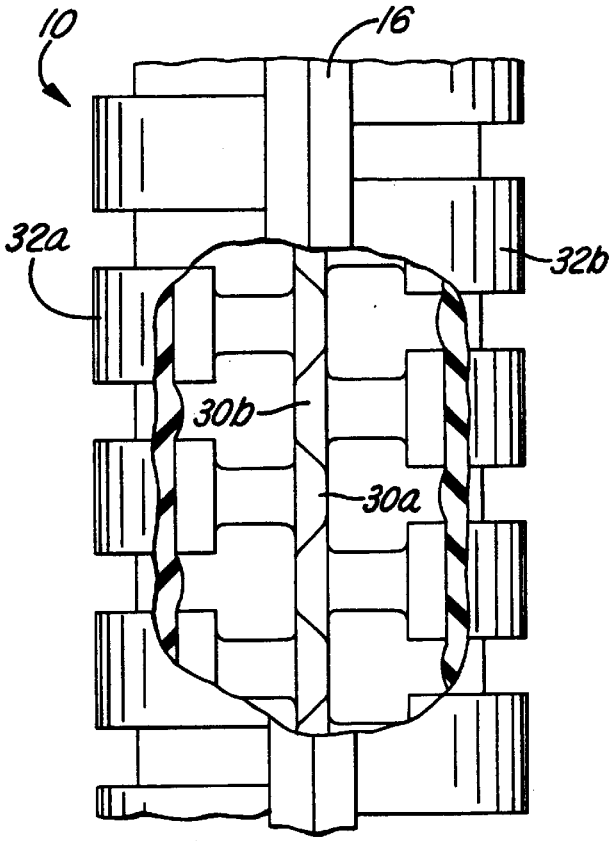
FIG. 5 is a partial sectional view of the zipper of FIG. 2.
Figure 6:
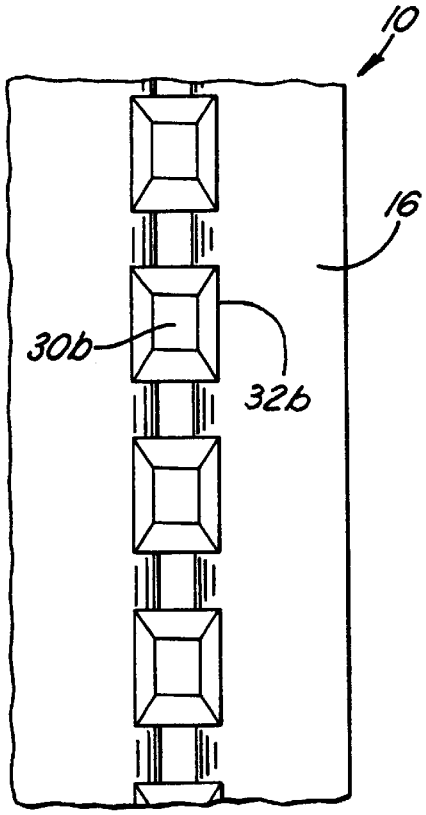
FIG. 6 is a side view of the zipper of FIG. 3 taken along line 6—6.

As best seen in FIGS. 3, 5 and 6, the zipper portion 14*a* consists of a set of interlocking inner teeth 30*a*, 30*b* separated from two sets of outer teeth 32*a*, 32*a* by a portion of the cloth material 16. As the slide fastener 19 is pulled upward and guided across the inner teeth 30*a*, 30*b* and the outer teeth 32*a*, 32*a* towards a closed position, the inner teeth 30*a*, 30*b* are interlocked to substantially seal. When the zipper portion 14*a* is in the closed position, signified when all of the inner teeth 32*a*, 32*a* are interlocked and the fastener 19 is at its uppermost position, water is not able to penetrate through any portion of the zipper 14 to the interior of the wader 10, thereby protecting a wearer's undergarments and body from water exposure.

Preferably, the inner teeth 30*a*, 30*b* and the outer teeth 32*a*, 32*a* of the zipper portion 14*a* are constructed of a material that is corrosion resistant and easy to manipulate from an open to a closed position. For example, the inner teeth 30*a*, 30*b* and the outer teeth 32*a*, 32*a* can be composed of plastic, a corrosion resistant metal or alloy, or stainless steel.

In another preferred embodiment (not shown), the zipper portion 14*a* may have a second tab accessible from the interior of the wader 10. This would allow the zipper portion 14*a* to be opened from the exterior or interior using either the tab 18 or second tab. It is specifically contemplated that other preferred embodiments of the chest wader 10 may have only an exterior tab 18, or only an interior tab, and still fall within the scope of the present invention.

In an alternative arrangement (not shown), a flap may extend over a portion of the zipper 14 and the tab 18. The flap functions to minimize water from being exposed to the zipper 14 and the tab 18. The flap is typically comprised of the same breathable waterproof material as the wader 10. This is useful in keeping the tab 18 dry for ease of use.

The breathable chest wader 10 having the zipper 14 is easily manufactured. The chest wader 10 may be manufactured having a vertical slit 12, or the vertical slit 12 may be cut into the chest wader 10 by techniques that are well known in the art. The zipper 14 is then attached to the inner portion 22 of the shell of the wader 10 by applying the waterproof sealing material 24 to the cloth portion 16, pressing the cloth portion 16 to the inner portion 22 of the shell, and drying the sealing material 24 between the cloth portion 16 and the inner portion 22 for a period of time sufficient to permanently seal the zipper 14 to the wader 10. In addition, the flap 20 may be added during the initial manufacture of the wader 10 or in a postproduction step by techniques that are well known in the art. As stated above, this flap 20 may be of the same material as the chest wader 10 or some other kind of waterproof material.

The present invention provides the wearer of a breathable chest wader 10 with a means for relieving himself without having to substantially remove the waders and/or any undergarments. Further, this is accomplished in a highly simplified manner, wherein the wearer would only need to be able to grab the tab 18 of the zipper portion 14*a* in order to move the slide fastener 19 from the closed position to the open position. Finally, the zipper portion 14*a* itself is fully waterproof in the closed position, thereby protecting the wearer and his underclothing from water.

While the above invention is described for use in a breathable chest wader 10, it is contemplated that the device may be used in many different kinds of water-related outerwear. For example, the zipper 14 could be incorporated into a breathable wetsuit.

While the invention has been described in terms of preferred embodiments, it will be understood, of course, that the invention is not limited thereto since modifications may be made by those skilled in the art, particularly in light of the foregoing teachings.

What is claimed is:

1. A waterproof relief outlet in a breathable chest wader comprising:

a vertical slit cut into a front portion of the breathable chest wader at a position in the vicinity of a wader crotch; and a non-corrosive zipper having a non-corrosive zipper portion coupled to and surrounded by a waterproof outer cloth portion, which is coupled to an interior breathable shell surface of the breathable chest wader around said vertical slit such that said non-corrosive zipper portion is exposed externally through said vertical slit, said non-corrosive zipper portion being moveable between a closed position and an open position;

wherein said non-corrosive zipper portion is internally exposed to a wearer's undergarments when in said closed position and wherein said non-corrosive zipper portion prevents water from entering the interior of the breathable chest wader through said non-corrosive zipper portion to a wearer's underclothing when said non-corrosive zipper portion is in said closed position.

2. The waterproof relief outlet of claim 1, wherein said non-corrosive zipper portion is selected from the group consisting of a non-corrosive plastic zipper portion and a non-corrosive metal zipper portion.

3. The waterproof relief outlet of claim 1, further comprising:

a flap coupled to an exterior breathable shell portion of the breathable chest wader, wherein said flap substantially covers said non-corrosive zipper portion.

4. The waterproof relief outlet of claim 1, wherein said non-corrosive zipper portion has a slide fastener, a first set of outer teeth, a second set of outer teeth, a first set of inner teeth, a second set of inner teeth, a raised flange, and a lower raised flange, wherein said first set of outer teeth are separated from said first set of inner teeth by a first cloth portion and said second set of outer teeth are separated from said second set of inner teeth by a second cloth portion.

5. The waterproof relief outlet of claim 4, wherein the movement of said slide fastener from said open position to said closed position causes said first set of inner teeth to intermesh with said second set of inner teeth and said slide fastener to abut said raised flange to substantially seal said zipper portion, thereby preventing seepage of water to an interior portion of said chest wader through said zipper portion.

6. The waterproof relief outlet of claim 4 further comprising:

a first tab coupled to said slide fastener, wherein said first tab is capable of moving said slide fastener from said closed position to said open position and from said open position to said closed position.

7. The waterproof relief outlet of claim 6 further comprising:

a second tab coupled to said slide fastener, wherein said first tab is positioned along an exterior side of the chest wader and said second tab is positioned within an interior side of the breathable chest wader, wherein said first tab and said second tab are separately capable of moving said slide fastener from said closed position to said open position and from said open position to said closed position.

8. The waterproof relief outlet of claim 1, wherein said waterproof outer cloth portion is sealed to said an interior breathable shell surface of the breathable chest wader using a waterproof sealing material, wherein said waterproof sealing material prevents water from entering the inside of the chest wader between said non-corrosive zipper and said interior breathable shell surface.

9. The waterproof relief outlet of claim 8, wherein said waterproof sealing material comprises neoprene cement.

10. A method for making a breathable chest wader having a relief outlet, the method comprising:

forming a vertical slit in a chest wader;

coupling a waterproof, non-corrosive zipper having a cloth portion and a zipper portion to the breathable chest wader such that said zipper portion is exposed through said vertical slit and is exposed to an interior breathable shell surface of the chest wader, said zipper portion being capable of moving between an open position and a closed position, wherein said closed position prevents leakage of water to the interior of the chest wader and to a wearer's underclothing through said zipper portion; and sealing said cloth portion of said waterproof, non-corrosive zipper to said interior breathable shell surface of the chest wader to prevent leakage of water from the exterior of the chest wader to the interior of the chest wader between said cloth portion and said interior breathable shell surface in said closed position.

11. The method of claim 10, wherein the step of sealing said cloth portion comprises sealing said cloth portion of said waterproof, non-corrosive zipper to said interior breathable shell surface using a waterproof sealing material.

12. The method of claim 11, wherein the step of sealing said cloth portion of said waterproof, non-corrosive zipper to said interior breathable shell surface using a waterproof sealing material comprises sealing said cloth portion of said waterproof, non-corrosive zipper to said interior breathable shell surface using a neoprene cement.

13. The method of claim 10 further comprising:

coupling a flap to the exterior of the chest wader, wherein said flap substantially covers said waterproof, non-corrosive zipper.

14. The method of claim 10 further comprising:

coupling a first tab to a slide fastener on said zipper portion.

15. The method of claim 14, further comprising:

coupling a second tab to said slide fastener, wherein said first tab is located along an exterior side of the chest wader and said second tab is located along an interior side of the chest wader.

16. A waterproof relief outlet in a chest wader comprising:

a vertical slit cut in a front portion of the chest wader at a position in the vicinity of a wader crotch;

a non-corrosive zipper coupled to and surrounded by an outer cloth portion, wherein said outer cloth portion is coupled to an interior breathable shell surface of the chest wader around said vertical slit such that said non-corrosive zipper is exposed to the exterior through said vertical slit, wherein said non-corrosive zipper portion is capable of movement from a closed position to an open position, wherein said non-corrosive zipper is in communication with a wearer's undergarments when in said closed position and wherein said non-corrosive zipper portion prevents water from entering the interior of the chest wader when said non-corrosive zipper portion is in said closed position; and a flap coupled to an exterior portion of the chest wader, said flap substantially covering said non-corrosive zipper.

17. The waterproof relief outlet of claim 16, wherein said non-corrosive zipper portion is selected from the group consisting of a non-corrosive plastic zipper portion and a non-corrosive metal zipper portion.

18. The waterproof relief outlet of claim 16, wherein said non-corrosive zipper portion has a slide fastener, a first set of outer teeth, a second set of outer teeth, a first set of inner teeth, a second set of inner teeth, a raised flange, and a lower raised flange, wherein said first set of outer teeth are separated from said first set of inner teeth by a first cloth portion and said second set of outer teeth are separated from said second set of inner teeth by a second cloth portion.

19. The waterproof relief outlet of claim 18, wherein the movement of said slide fastener from said open position to said closed position causes said first set of inner teeth to intermesh with said second set of inner teeth and said slide fastener to abut said raised flange to substantially seal said zipper portion, thereby preventing seepage of water to an interior portion of said chest wader through said zipper portion.

20. The waterproof relief outlet of claim 18 further comprising a first tab coupled to said slide fastener, wherein said first tab is capable of moving said slide fastener from said closed position to said open position and from said open position to said closed position.

* * * * *